US005808255A

United States Patent [19]

Sehlhorst et al.

[11] Patent Number: 5,808,255

[45] Date of Patent: Sep. 15, 1998

[54] FLUID PRESSURE RESPONSIVE ELECTRIC SWITCH

[75] Inventors: Scott B. Sehlhorst, Lexington; James R. Thayer; John T. Hancock, both of Versailles, all of Ky.

[73] Assignee: Texas Instruments Incorporated, Dallas, Tex.

[21] Appl. No.: 681,251

[22] Filed: Jul. 22, 1996

[51] Int. Cl.[6] ..... H01H 35/24

[52] U.S. Cl. ..... 200/83 P; 200/83 P; 200/302.1

[58] Field of Search ..... 200/83 R, 83 P, 200/83 J, 835, 835 A, 302.1

[56] References Cited

U.S. PATENT DOCUMENTS

| | | | |
|---|---|---|---|
| 3,816,685 | 6/1974 | Fiore | 200/835 |
| 4,243,858 | 1/1981 | Place | 200/83 P |
| 4,296,287 | 10/1981 | Boulanger et al. | 200/83 P |
| 4,328,406 | 5/1982 | Evans et al. | 200/293 |
| 4,469,923 | 9/1984 | Charboneau | 200/83 P |
| 4,641,121 | 2/1987 | Boulanger | 337/380 |
| 4,757,165 | 7/1988 | Marcoux et al. | 200/83 P |
| 4,998,087 | 3/1991 | Boulanger | 200/83 J X |
| 5,121,094 | 6/1992 | Ting et al. | 200/83 P X |
| 5,123,332 | 6/1992 | Thayer et al. | 200/83 P X |
| 5,300,741 | 4/1994 | Hogue et al. | 200/83 P |

*Primary Examiner*—J. R. Scott

*Attorney, Agent, or Firm*—Russell E. Baumann; Richard L. Donaldson; René E. Grossman

[57] ABSTRACT

A fluid pressure responsive electric switch (10) is shown having an elongated base (12) in which first and second terminals (34, 48) are mounted by dropping them into respective slots (26, 28). The terminals are provided with tabs (38, 52) to engage with a platform (30) of the base to limit motion in one direction and are in turn engaged by a guide member (62) to prevent motion in an opposite direction. The guide member (62) has a cylindrical force transfer portion (86) aligned with the weld portion (104) of a sensor assembly (92) to transfer force without adversely affecting the calibration of the sensor assembly. Electrical leads (118, 120) have connectors (126, 128) attached to an end thereof along with cylindrical gaskets (134) which form an interference fit in bores (22, 20) of the base to provide an environmental seal at the same time electrical connection is made to the terminals. In a modified embodiment a special thermal isolation fitting (140) is shown particularly adapted for use in sealed refrigeration applications.

9 Claims, 4 Drawing Sheets

FLUID PRESSURE RESPONSIVE ELECTRIC SWITCH

BACKGROUND OF THE INVENTION

1. Field of the Invention

This invention relates generally to fluid pressure responsive electric switches and methods for making them, and more particularly to certain specific features for making such switches more reliable with less variability from one switch to another and at lower cost.

2. Description of the Related Art

Devices for opening and closing an electric circuit in response to changes in values of fluid pressure by admitting the fluid pressure to one side of a rapid deflection actuator, such as a snap acting diaphragm, causing it to move from a first configuration to a second configuration at a predetermined actuation pressure value and return at another deactuation pressure value are well know. Typically, a motion transfer member is movably mounted adjacent to the actuator and adapted to transfer motion from the actuator to a movable arm of an electric switch.

A continuing need exists in the industry to improve the reliability of such switches and at the same time lower their unit costs. One area in which improvement is desired relates to providing switches which will more consistently operate within design specifications for actuation and deactuation pressure levels. Various prior art means have been devised to adjust or calibrate devices in order to obtain consistent actuation and deactuation from device to device. For example, the length of the motion transfer member can be selected to compensate for variations in distance between the actuator and the movable arm of the switch. In some devices the movable switch arm can be adjusted by varying the angle of a bracket mounting the arm. In some devices the position of the stationary contact of the switch can be adjusted by means of a threaded member aligned with the contact. Although such devices can generally be brought into a desired specification using such adjustment techniques they add to the cost of the switch by adding components in some cases and adding operations in others.

Another area in which improvement is desired is in providing an effective environmental seal which is of low cost and is conducive to mass manufacturing techniques. Various sealing techniques are disclosed in the prior art including the use of an outer housing in which the switch is disposed with epoxy infilled around the terminals extending from the switch as shown in U.S. Pat. No. 3,816,685. This technique is effective, however, it significantly adds to assembly time to allow for adequate curing. In addition, storage space is tied up while the epoxy is curing and special holding means is required for holding the switches during the curing period.

SUMMARY OF THE INVENTION

It is an object of the present invention to provide a fluid pressure responsive electric switch which overcomes the prior art limitations noted above. Another object of the invention is the provision of a method for assembling such a switch which is more cost effective than prior art methods. Yet another object of the invention is the provision of an improved pressure responsive electric switch which is less expensive to produce than prior art devices, which is particularly suitable for automated assembly techniques and which operates within the design specifications consistently from device to device. Another object of the invention is to improve the precision of such switches thereby allowing tighter pressure set point windows to be specified so that the switches can be applied in end products where prior art devices are impractical.

Briefly, in accordance with a preferred embodiment of the invention, a fluid pressure responsive electric switch comprises an elongated generally cylindrical base having a first open end formed with a radially, outwardly extending flange at the first end and an opposite second end having first and second bores leading to a switch chamber. First and second, diametrically opposed, longitudinally extending slots are formed in the switch chamber portion of the sidewall of the base for reception of respective first and second switch terminals.

For a normally open switch a first terminal mounting a stationary contact disposed at a selected angle relative to the direction of movement of a mating movable contact is placed in the base through the open first end and is received in the first slot. The position of a terminal along the longitudinal axis is determined by the engagement of a first surface of a laterally extending tab of the terminal with a platform surface of the base. A second terminal mounting a laterally extending movable contact arm is then placed in the base through the open first end and is received in the second slot with its position along the longitudinal axis determined by a corresponding first surface of a laterally extending tab of the terminal engaging the platform surface.

A motion transfer pin guide member comprising a hub having a pin receiving longitudinally extending bore has a first cylindrical wall portion received in the first open end of the base. The first cylindrical wall portion has a portion extending radially outwardly forming first and second seal seats and a second cylindrical wall portion extends away from the base culminating in a force transfer surface generally in alignment with the wall of the base.

A sensor assembly, disposed over the pin guide member, comprises a disc support member having a centrally disposed pin receiving bore, a disc housing having a suitable fluid receiving aperture therethrough and one or more rapid deflection actuators, such as snap acting discs, sandwiched between the disc support and the disc housing. The sensor assembly parts are all welded together about their outer, generally circular, periphery forming an hermetic seal preventing escape of the working fluid of the system being monitored.

First and second flexible O-rings are disposed on the respective first and second seal seats and a motion transfer pin is slidably received in the bores of the guide member and the disc support. The base, guide member, sensor assembly and O-rings are compressed together by a spring retaining sleeve extending between the flange on the base and the sensor assembly with the guide member engaging second surfaces of the lateral terminal portions opposed to the first surfaces to lock the terminal portions against the platform surface at a selected longitudinal position with the force transfer surface of the guide member engaging the sensor assembly through the outer welded peripheral portion.

First and second wire leads, each having an insulative layer, are provided with tubular gaskets received on the insulative layer and female connectors attached to respective stripped ends of the wire leads. The gaskets have an outer diameter portion selected to form an interference fit with the first and second bores respectively of the second end of the base. The leads are inserted into the respective first and second bores with the female connectors electrically engaging male connector portions of the respective terminal members at the same time that the gaskets are forced into the bores forming an environmental seal.

Various fittings may be attached to the disc housing to interface with a fluid pressure source to be monitored, such as a conventional threaded fitting shown in FIG. 1. According to a modified embodiment a thermal isolation fitting is provided comprising an elongated copper clad stainless steel tubular member which is hermetically attached to the disc housing and which can be conveniently hermetically attached to a system such as an hermetic refrigeration system by brazing, welding or the like without the need of a conventional heat sink normally required during such installation.

BRIEF DESCRIPTION OF THE DRAWINGS

The details of the invention will be described in conjunction with the accompanying drawings in which.

Similar reference characters indicate corresponding parts throughout the several views of the drawings.

DESCRIPTION OF THE PREFERRED EMBODIMENTS

Figure 1:
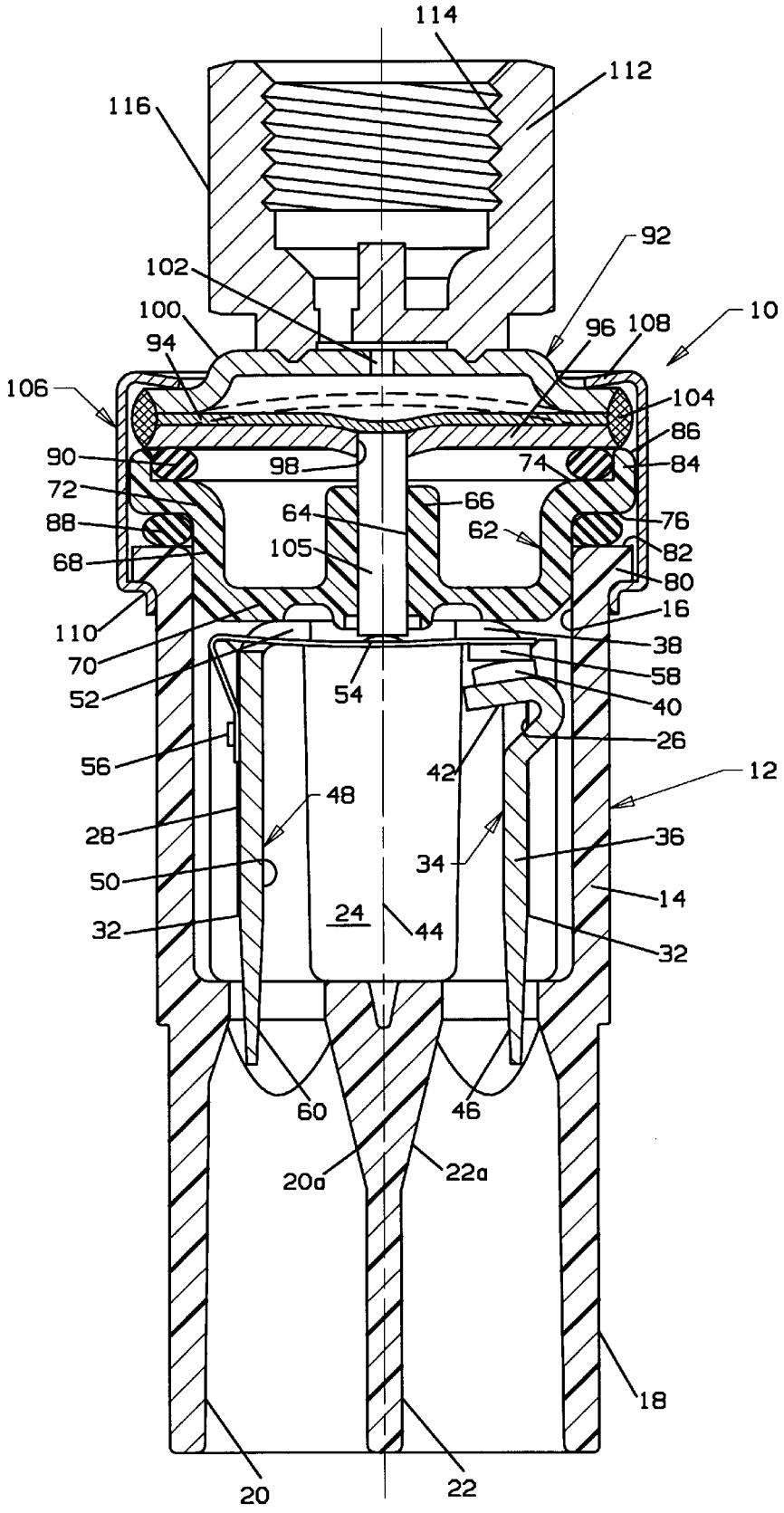
FIG. 1 is a cross sectional view of a fluid pressure responsive electric switch made in accordance with the invention prior to the attachment of electrical leads thereto.

With reference to FIGS. 1–5, fluid pressure responsive switch 10 made in accordance with the invention comprises a generally elongated tubular base member 12 having a longitudinal axis 44 and being made of suitable electrically insulative material such as PBT, polybutylpteraphthalate. Base member 12 has a cylindrical wall 14 extending from a first open end 16 to a second end 18 having first and second bores 20, 22 extending parallel to longitudinal axis 44 into a switch cavity 24.

Sidewall 14 is formed with first and second longitudinally extending slots 26, 28 within the base which extend from a platform surface 30 adjacent to open end 16 of base 12 to a location 32 adjacent the inner ends of bores 20, 22.

A first terminal 34 has a pair of sidewall members 36 which are slidably received in slot 26. The sidewall members each has a laterally extending tab 38 which engages platform 30 to limit motion of the terminal into slot 26. In the normally open switch terminal 34 is provided with stationary electrical contact 40 mounted on a support 42 disposed at a selected angle relative to a plane generally perpendicular to the direction of movement of a movable contact to be discussed below. Terminal 34 is also formed with a male connector portion 46 which depends downwardly into bore 22.

A second terminal 48 has a similar pair of sidewall members 50 which are slidably received in slot 28. Laterally extending tabs 52 extend from sidewall members 50 and serve to engage platform 30 to limit motion of the terminal in slot 28. Terminal 48 is provided with an electrically conductive, movable spring contact arm 54 which is mounted to the terminal at one end at 56 and which mounts an electrical contact 58 at its opposite end. Contact 58 is movable into and out of engagement with stationary contact 40 with contact arm 54 having a spring force biasing the contact in the contacts disengagement position. Terminal 48 also has a male connector portion 60 depending downwardly therefrom into bore 20 of base member 12.

A motion transfer pin guide member 62 having a longitudinally extending bore 64 formed through a centrally disposed hub 66 is mounted at the open end 16 of base 12. Guide member 62 has a first cylindrical wall portion 68 which slidingly fits within open end 16 connected to hub 66 by a radially extending wall 70 which engages the top surface of tabs 38, 52 to lock terminals 34, 48 against platform 30 of base 12. At the opposite end of cylindrical wall 68, a radial wall portion 72 extends outwardly over the distal end portion of wall 14 and forms first and second seal seats 74, 76 respectively on opposite upper and lower surfaces thereof. An outwardly extending flange 80 is formed at the distal end of wall 14 of the base forming a seal seat surface 82 lying in a plane perpendicular to the longitudinal axis 44 of base 12 as well as forming a projection for a retention sleeve to be described below.

A second cylindrical wall portion 84 extends upwardly from the outer portion of the wall portion 72, that is, in a direction away from base member 12, and culminates in a force transfer surface 86. A first flexible O-ring 88 is received between surface 82 of base member 12 and seal seat 76 and a second flexible O-ring 90 is received on seal seat 74.

A sensor assembly 92 comprises one or more rapid actuator elements 94, such as snap-acting discs (the number selected being dependent on the pressure levels to be monitored), sandwiched between a disc support plate 96 having a centrally disposed bore 98 and a disc housing 100 having a fluid receiving orifice 102 welded about their peripheries as indicated at 104. The discs, support plate and disc housing are generally circular in plan view with a circular weld portion 104 having a selected diameter no greater than the diameter of the circular force transfer portion 86 for a purpose to be described below.

After placing a motion transfer pin 105 in bore 64, the sensor assembly is placed on top of guide member 62 with pin 105 received in bore 98 of support plate 96.

A retainer sleeve 106 formed of material having good spring characteristics has one end formed with an inwardly extending wall portion 108 received on the top surface of disc housing 100 and, with a selected force applied to the disc housing in a direction toward the base member 12, the opposite end of retainer sleeve 106 is crimped over flange 80 at 110 to lock the several parts of the switch together with the parts in a preselected dimensional relationship with one another along the longitudinal axis.

A suitable fitting 112 having a configuration selected in view of the application in which the switch is to be used is hermetically attached to disc housing 92 in a known manner. As shown, fitting 112 has an internal thread 114 and a conventional hexagonal outer surface 116.

As thus far described, switch 10 is assembled by dropping terminals 34, 48 in their respective slots, then placing the guide member 62 and pin 105 along with the associated O-rings 88, 90, at the open end 16 of the base member. Retainer sleeve 166 is placed over the sensor assembly and a force is applied to the disc housing toward the base sufficient to deform the O-ring seals which may require, for example, 25 pounds, the force then being applied through the weld portion 104 to the force transfer surface 86 and to tabs 38, 52 against the base thereby ensuring that the terminals are in a preselected longitudinal location with a consistent, given distance between the sensor assembly and the switch assembly. The retainer sleeve is crimped at 110 to lock the parts in their respective positions with a spring force applied to disc housing through wall portion 108 to maintain this dimensional relationship among the parts. The amount of force employed is sufficiently in excess of the force required to deform the O-rings to ensure that the sensor assembly, pin guide member, terminals and base are all fixed in a given position relative to one another along the longitudinal axis. Approximately 75 pounds has been found to be suitable in the described embodiment.

Selecting the diameter of force transfer portion 86 to be no less than the diameter of weld portion 104 of the sensor assembly avoids imparting a moment in the disc support which could cause a calibration shift of the disc(s). That is, if the force were transmitted inboard of the weld the disc support could be displaced thereby affecting the deactuation pressure level of the sensor assembly. The force transferred through O-ring 90 is sufficiently low that it has no significant affect on the calibration of the sensor assembly.

As mentioned above, stationary contact 40 is mounted on a support which lies in a plane forming a selected angle with the direction of movement of movable contact 58. The angle chosen is one to bring planes in which the contacts lie into a parallel state when the movable contact arm is fully deflected in the electrically energized condition. This arrangement optimizes heat sinking characteristics of the contacts and allows more of the contact material to be utilized compared to conventional arrangements in which the contact planes are in a parallel state upon initial engagement prior to the full deflection of the movable spring contact arm. The particular angle selected is dependent upon the characteristics of the actuator and the design of the movable spring contact arm. As shown, the angle is approximately 10 degrees.

Figure 2:
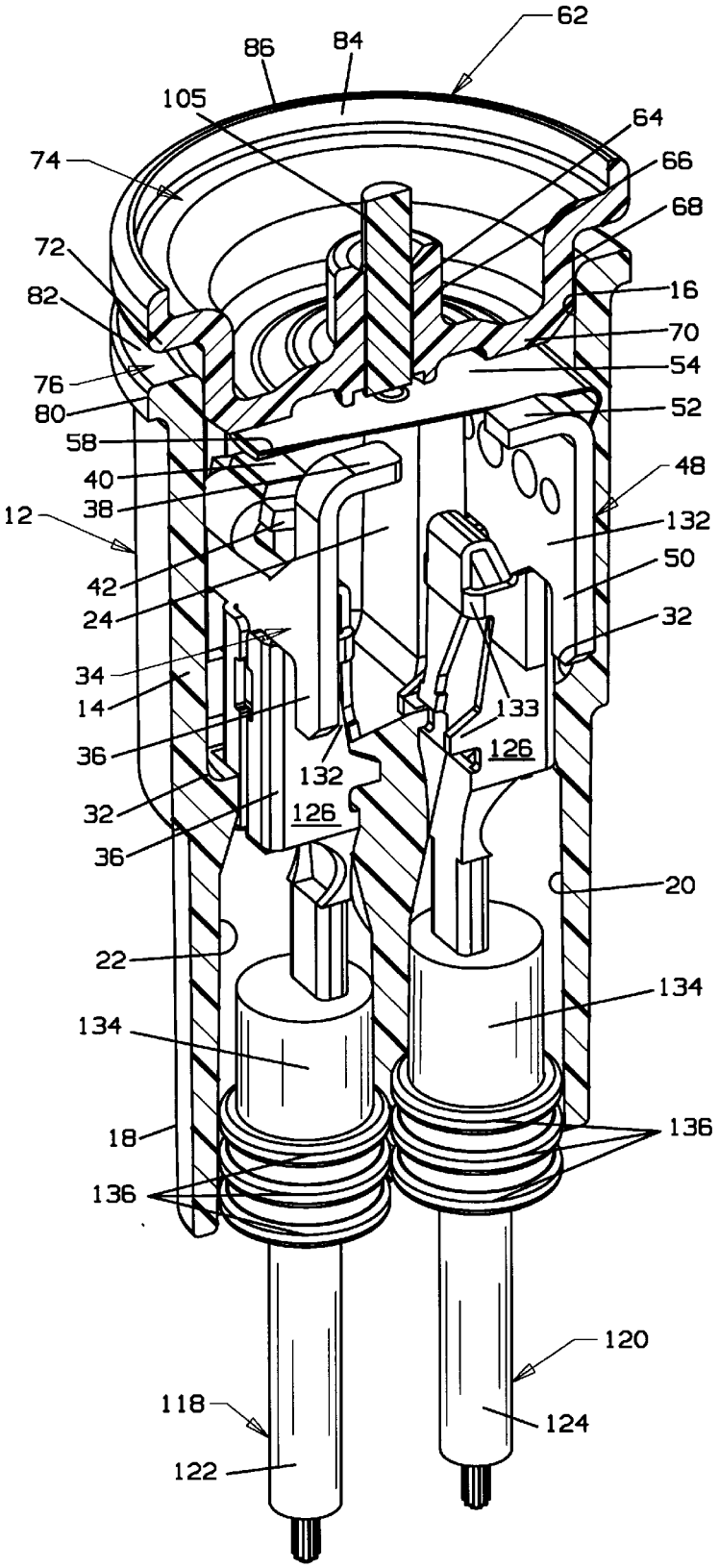
FIG. 2 is a cross section of a perspective view of a base and pin guide member of a switch made in accordance with the invention with electrical leads attached.
Figure 3:
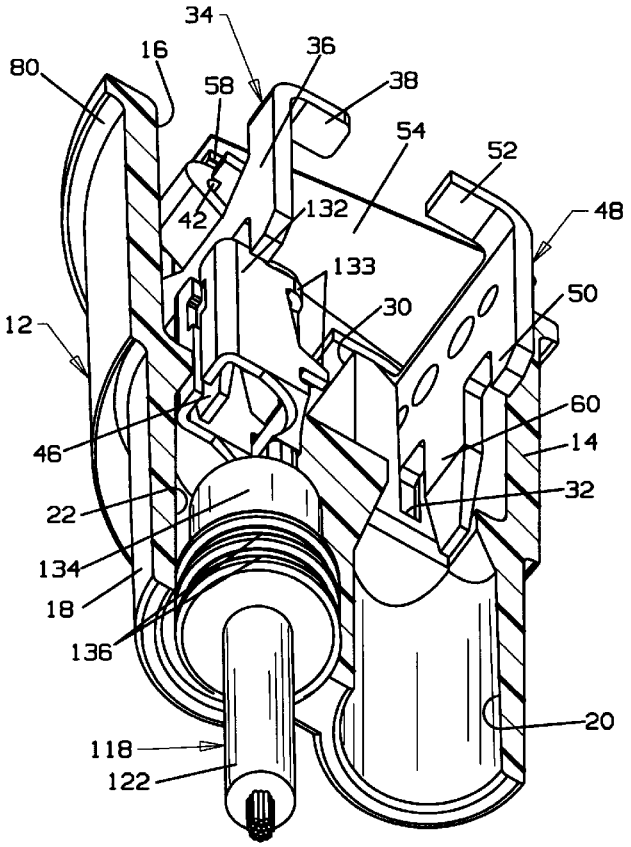
FIG. 3 is a slightly enlarged cross section of a perspective view of the FIGS. 1, 2 base with terminals installed and with an electrical lead attached to one terminal.
Figure 4:
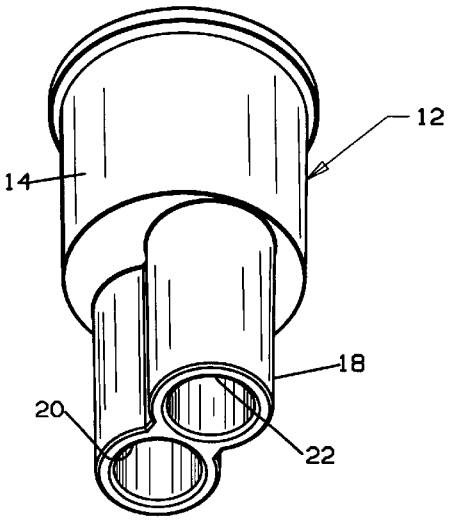
FIG. 4 is a perspective view of the base of the FIG. 1 switch.
Figure 5:
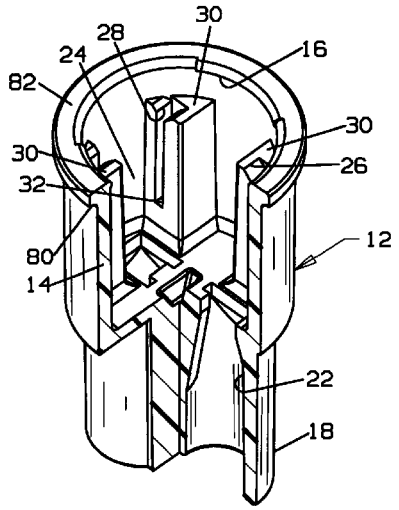
FIG. 5 is a perspective view, partly broken away, of the FIG. 4 base.
Figure 6:
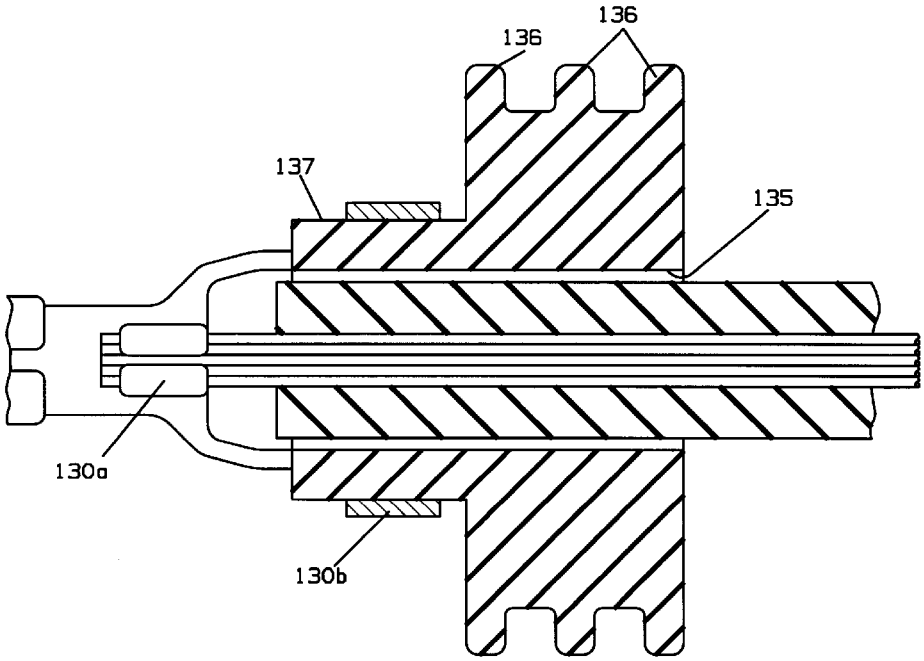
FIG. 6 is an enlarged cross sectional view of a portion of an electrical lead showing the attachment of the connector to the lead and gasket.

With reference to FIGS. 2, 3 and 6, first and second electrical leads 118, 120 having an insulative layer 122, 124 respectively are each provided with a respective female connector 126. Connectors 126 (see FIG. 6) have at one end a first portion 130*a* which crimps onto the metallic portion of the respective lead and a second portion 130*b* which crimps onto a respective gasket 134. The opposite end of the connectors are formed into female receiving portions 132. Gasket 134, a generally tubular, preferably resilient member having a bore 135 with a diameter selected to form a close fit with the conductive layers 122, 124 is placed on each lead. Gaskets 134 have an outer diameter selected to form an interference fit with bores 20, 22 of base member 12. Although gaskets 134 are shown in FIG. 6 with connector portions clamped to a small diameter portion 137 by connector portion 130*b*, for the sake of convenience of illustration this feature is not shown in FIGS. 2 and 3. Preferably, a plurality of ribs 136 having the selected diameter are formed about the outer perimeter of the gasket to create an interface between the gaskets and base 12 of high pressure. If desired, ribs (not shown) may also be formed in bore 135 to create a high pressure interface between the leads and the gaskets. Upon assembling the switch the leads are inserted into respective bores 20, 22 with tapered surfaces 20*a*, 22*a* of the bores in cooperation with the generally angled side portion 133 of the connectors serving to orient the angular position of the connectors. The female connectors are spaced from the gaskets a distance selected so that the female connectors are received on the male connector portions 46, 60 preferably at the same time that the gaskets are inserted into bores 20, 22 thereby simultaneously making electrical connection with the switch and providing an environmental seal by compressing the gaskets against both the insulative layers of the leads as well as the surface of base 12 defining bores 20, 22. Essentially, the distance between connectors 126 and their respective gaskets 134 is less than the distance between male connector portions 46, 60 respectively and the outer end of respective bores 22, 20. Although a normally open switch has been described, it will be appreciated that the logic of the switch can be reversed by placing contacts 40, 58 on the opposite side of movable contact arm 54. In that case the terminal mounting the movable contact arm would be inserted in the base prior to the insertion of the stationary contact terminal. Further, it will be understood that the number of bores and longitudinally extending slots in base 12 depend on the number of electrical leads required for the switch. For example, for a single pole, double throw switch, the base would be provided with three bores and three longitudinal slots.

Figure 7:
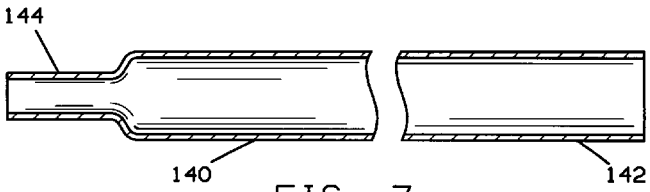
FIG. 7 is a reduced cross sectional view of a thermally isolated interface for use between the FIGS. 1, 2 switch and a fluid pressure system to be monitored.

With reference to FIG. 7, an improved thermal isolation fitting is shown which is particularly useful with switch 10 when the switch is to be used in a sealed system such as a sealed refrigeration system. Fitting 140 is a generally tubular, elongated element formed of clad metal having an outer layer of copper to facilitate hermetic connection by a suitable process such as brazing to copper fittings in the refrigeration system and an inner layer of stainless steel to decrease thermal conductivity and thereby obviate the need for a conventional heat sink during the brazing process. End 142 of the fitting is hermetically attached to switch 10 at the time of manufacture while end 144 is attached to the refrigeration system in-situ. It will be realized that fitting 140 could be used with thermally responsive switches or other components such as solenoid valves, reversing valves, heat exchanges or the like as well as pressure responsive switches and therefore come within the purview of the invention.

In view of the above, it will be seen that the several objects of the invention are achieved and other advantageous results attained.

As many changes could be made in the above constructions and methods without departing from the scope of the invention, it is intended that all matter contained in the above description or shown in the accompanying drawings, shall be interpreted as illustrative and not in a limiting sense. It is also intended that the appended claims shall cover all such equivalent variations as come within the spirit and scope of the invention.

What is claimed:

1. A condition responsive electric switch comprising an elongated, generally tubular base having a longitudinal axis and having a sidewall extending between first and second open ends, a guide member disposed at the first end of the base for slidably mounting a motion transfer member, the guide member having a cylindrical portion at the outer periphery thereof extending away from the base, the cylindrical portion having a longitudinal axis coaxial with the longitudinal axis of the base and having a selected diameter, the cylindrical portion having a force transmitting distal end, a fluid pressure responsive sensor assembly comprising a disc support plate having a centrally located bore therethrough, a disc housing member and at least one snap-acting disc disposed between the support plate and the housing member, the support plate, housing member and disc all having outer circular peripheral portions welded together and being generally in alignment with said force transmitting distal end of said cylindrical portion of said guide member, means to apply a force between the sensor assembly and the base, the diameter of the force transmitting distal end of the cylindrical wall portion being no less than the diameter of the welded outer peripheral portions of the support plate, housing member and disc with the force applied between the sensor assembly and the base being transferred through the force transmitting distal end of the cylindrical portion of the guide member and the welded portion of the sensor assembly, an electric switch disposed within the base and a motion transfer member slidably mounted in the guide member and extending through the bore in the disc support plate between the at least one disc and the electric switch.

2. A condition responsive electric switch according-to claim 1 in which the means to apply a force between the sensor assembly and the base comprises a retention sleeve having an end crimped over a flange provided on the base member and another end applying a force on the sensor assembly.

3. A condition responsive electric switch according to claim 1 further including seal means for environmentally sealing said electric switch in which the guide member has a wall portion extending radially outwardly with opposed upper and lower O-ring seats generally in alignment with the sidewall of the base member and first and second deformable gaskets received on the upper and lower O-ring seats respectively.

4. A condition responsive electric switch according to claim 1 including a thermal isolation fitting comprising an elongated tubular element composed of copper clad stainless steel having an end hermetically attached to the sensor assembly and an opposite end for hermetic connection to a system to be monitored.

5. A condition responsive electric switch comprising an elongated tubular base member having a longitudinal axis and having a wall with a first open end communicating with a switch cavity and a second end having first and second bores communicating with the switch cavity, a laterally extending platform formed in the wall adjacent the first open end, first and second terminal receiving slots extending longitudinally from the platform toward the first and second bores, first and second terminals slidably received in the respective slots, the terminals having a laterally extending tab received on the platform to limit motion of the terminal from the first end toward the second end of the base, the terminals each having a connector portion extending toward a respective bore, a movable contact arm mounted on one terminal movable into and out of electrical engagement with the other terminal, a guide member having a longitudinally extending bore received in the first open end of the base member, the guide member engaging the terminal tabs to prevent motion in a direction from the second end to the first end of the base member, first and second electrical leads having non-conductive layers and a connector attached to a respective end of each lead, a generally tubular gasket received over the non-conductive layer of each lead and having an outer diameter selected to form an interference fit with the first and second bores, the connectors spaced from the gaskets a selected distance whereby insertion of the leads into the bores will effect electrical connection with respective connector portions of the terminals simultaneously as an environmental seal is formed between the gaskets and the respective first and second bores, a sensor assembly mounted on the guide member and a motion transfer member slidably mounted in the bore of the guide member and extending between the sensor assembly and the movable contact arm.

6. A condition responsive electric switch according to claim 5 in which each gasket has a reduced diameter portion and the respective connector is crimped to the reduced diameter portion to prevent axial movement of the gasket relative to the respective lead.

7. A condition responsive electric switch according to claim 5 in which the gaskets are formed of resilient material having a plurality of circumferential ribs extending about the outer periphery of the gaskets.

8. A condition pressure responsive electric switch comprising an elongated, generally tubular base having a longitudinal axis and having a sidewall extending between first and second open ends, a flange extending radially outwardly from the first end of the sidewall forming a surface at the first end lying in a plane generally perpendicular to the longitudinal axis, a guide member mounted at the first end of the base for slidably mounting a motion transfer member, the guide member having a central hub formed with a longitudinally extending bore through the hub, the guide member having a wall portion extending radially outwardly with opposed upper and lower O-ring seats generally in alignment with the surface of the first end of the base, the wall portion of the guide member having a cylindrical portion at the outer periphery thereof extending away from the base, the cylindrical portion having a longitudinal axis coaxial with the longitudinal axis of the base and having a selected diameter, the cylindrical portion having a force transmitting distal end, a condition responsive sensor assembly comprising a disc support plate having a centrally located bore therethrough, a disc housing member and at least one snap-acting disc disposed between the support plate and the housing member, the support plate, housing member and disc all having outer circular peripheral portions welded together, first and second deformable gaskets received on the opposed upper and lower O-ring seats respectively, means to apply a force between the sensor assembly and the flange, the diameter of the force transmitting distal end of the cylindrical wall portion being essentially equal to the diameter of the welded outer peripheral portions of the support plate, housing member and disc so that the force applied between the sensor assembly and the flange is transferred through the force transmitting distal end of the cylindrical portion of the guide member and the welded portion of the sensor assembly, an electric switch disposed within the base and a motion transfer member slidably received in the bore of the guide member and extending through the bore in the disc support plate between the at least one disc and the electric switch and environmental seal means to seal the electric switch from the environment.

9. A condition responsive electric switch according to claim 8 including a thermal isolation fitting comprising an elongated tubular element composed of copper clad stainless steel having an end hermetically attached to the sensor assembly and an opposite end for hermetic connection to a system to be monitored.

* * * * *